United States Patent [19]

Stodd et al.

[11] Patent Number: 4,955,223

[45] Date of Patent: Sep. 11, 1990

[54] METHOD AND APPARATUS FOR FORMING A CAN SHELL

[75] Inventors: Ralph P. Stodd, Dayton; Harry D. Stewart, Tipp City, both of Ohio

[73] Assignee: Formatec Tooling Systems, Inc., Dayton, Ohio

[21] Appl. No.: 436,724

[22] Filed: Nov. 15, 1989

Related U.S. Application Data

[63] Continuation-in-part of Ser. No. 296,951, Jan. 17, 1989, abandoned.

[51] Int. Cl.[5] ..... B21D 51/44

[52] U.S. Cl. ..... 72/336; 72/348

[58] Field of Search ..... 72/329, 336, 347, 348, 72/354, 361

[56] References Cited

U.S. PATENT DOCUMENTS

| | | |
|---|---|---|
| 3,413,835 | 12/1968 | Master . |
| 3,844,154 | 10/1974 | Bozek . |
| 4,093,102 | 6/1978 | Kraska . |
| 4,571,978 | 2/1986 | Taube et al. . |
| 4,587,825 | 5/1986 | Bulso, Jr. et al. . |
| 4,587,826 | 5/1986 | Bulso, Jr. et al. . |
| 4,713,958 | 12/1987 | Bulso, Jr. et al. . |
| 4,800,743 | 1/1989 | Bulso, Jr. et al. . |

*Primary Examiner*—Lowell A. Larson
*Attorney, Agent, or Firm*—Jacox & Meckstroth

[57] ABSTRACT

A sheet of metal is blanked by an annular die to form a disk, and a peripheral portion of the disk is gripped between the blank die and a lower pressure sleeve. The peripheral portion is shifted downwardly relative to a center portion of the disk engaged by a center panel punch to form a center panel portion and a panel wall portion connected by a generally frusto-conical inverted chuck wall portion to the peripheral wall portion. The center panel portion and the panel wall portion are engaged by a die center having a projecting lip with a small countersink radius. An inner part of the peripheral wall portion is gripped between a die core ring and an upper pressure sleeve to define a crown portion, and an outer part of the peripheral portion of the disk is formed by the blank die and the die core ring into a depending lip portion. The center panel portion is shifted downwardly by the die center and panel punch in a direction to reverse form the inverted chuck wall portion into a chuck wall portion and a countersink portion by laying the metal around the countersink radius on the die center. After an overstroke operation, the completed shell is removed with the use of air jets within the panel punch and a vent passage within the center die.

21 Claims, 3 Drawing Sheets

METHOD AND APPARATUS FOR FORMING A CAN SHELL

RELATED APPLICATION

This application is a continuation-in-part of application Ser. No. 296,951, filed Jan. 17, 1989, now abandoned.

BACKGROUND OF THE INVENTION

In apparatus or tooling for forming end panels or shells for metal cans or plastic containers, for example, as disclosed in U.S. Pat. Nos. 4,093,102, 4,587,825, 4,587,826 and 4,637,961, it is desirable to construct the tooling so that the shells are produced from sheet metal or aluminum having a minimum gage or thickness. On the other hand, it is necessary for each shell to have sufficient strength for withstanding a predetermined pressure within the can without deforming or buckling. It is also desirable for the tooling to provide for high volume production of the shells on either a single or multiple action press and to complete the forming of each shell at a single station in order to avoid complicated reforming operations. Commonly, an end panel or shell includes a circular center panel which is connected by a panel radius to a U-shaped countersink portion having a countersink radius. The countersink portion is connected by a tapering or frusto-conical chuck wall portion to an upper crown portion which extends outwardly to a depending peripheral lip portion.

One of the common problems encountered in producing end panels or shells is the stretching and thinning of the sheet metal when forming a small panel radius and a small countersink radius. If there is stretching and thinning of the sheet metal in these areas, the strength of the shell rapidly decreases, with the result that the shells are unacceptable for use. The stretching and thinning of the sheet metal around the panel radius and countersink radius usually result from tooling which draws the chuck wall and center panel from the sheet metal or draws the center panel after drawing the chuck wall with a reforming operation, such as disclosed in the above-mentioned patents.

SUMMARY OF THE INVENTION

The present invention is directed to an improved method and apparatus for efficiently producing end panels or shells for cans and other containers and which is adapted for use in either a single or multiple action press for completely forming the shells within a single station tooling cavity. The method and apparatus of the invention provide for significantly reducing the thickness or gage of the sheet metal used for producing the shells by avoiding stretching and thinning of the sheet metal around each radius, especially the panel radius and the countersink radius. In addition, the invention provides for maintaining the precision and uniform dimensions of the shell by compensating for thermal expansion in the press and tooling so that high reliability and high quality control are obtained and down time of the press is minimized.

The above advantages and features are provided by a tooling assembly or system which first blanks a disk from a thin metal sheet and then grips and shifts a peripheral portion of the disk axially or downwardly relative to a center portion of the disk to define a center panel portion and a generally frusto-conical intermediate or inverted chuck wall portion connecting the panel portion to the peripheral portion. An inner part of the peripheral portion is gripped to define a crown portion, and an outer part of the peripheral portion is formed into a lip portion depending from the crown portion. The center panel portion is shifted axially or downwardly relative to the crown portion and in a direction to reverse form the intermediate or inverted chuck wall portion and lay it smoothly around the countersink radius to form a chuck wall portion and a precision countersink portion without stretching and thinning of the metal around the panel radius and the countersink radius. After an overstroke operation, the part or shell is ejected with the use of air jets directed upwardly against the shell.

Other features and advantages of the invention will be apparent from the following description, the accompanying drawings and the appended claims.

DESCRIPTION OF THE PREFERRED EMBODIMENT

Figure 12:
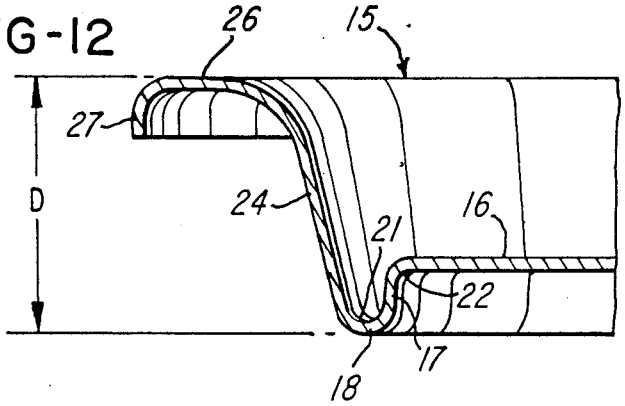
FIG. 12 is an enlarged fragmentary section of a shell produced by the tooling system shown in FIGS. 1–10.

Referring to the drawings, FIG. 12 shows a greatly enlarged shell 15 which is formed from aluminum having a thickness of about 0.010 inch. The shell 15 includes a circular center panel portion 16 which is connected by a cylindrical or tapered panel wall portion 17 to an annular countersink portion 18 having a U-shaped cross-section. The countersink portion 18 has a countersink radius 21 of about 0.015 inch, and a panel radius 22 of about 0.015 inch connects the center panel portion 16 and the panel wall portion 17. A tapered or frusto-conical chuck wall portion 24 connects the countersink portion 18 to a crown portion 26, and a peripheral lip portion 27 depends from the crown portion 26. The countersink portion 18 has a depth D from the top of the crown portion 26.

Figure 1:
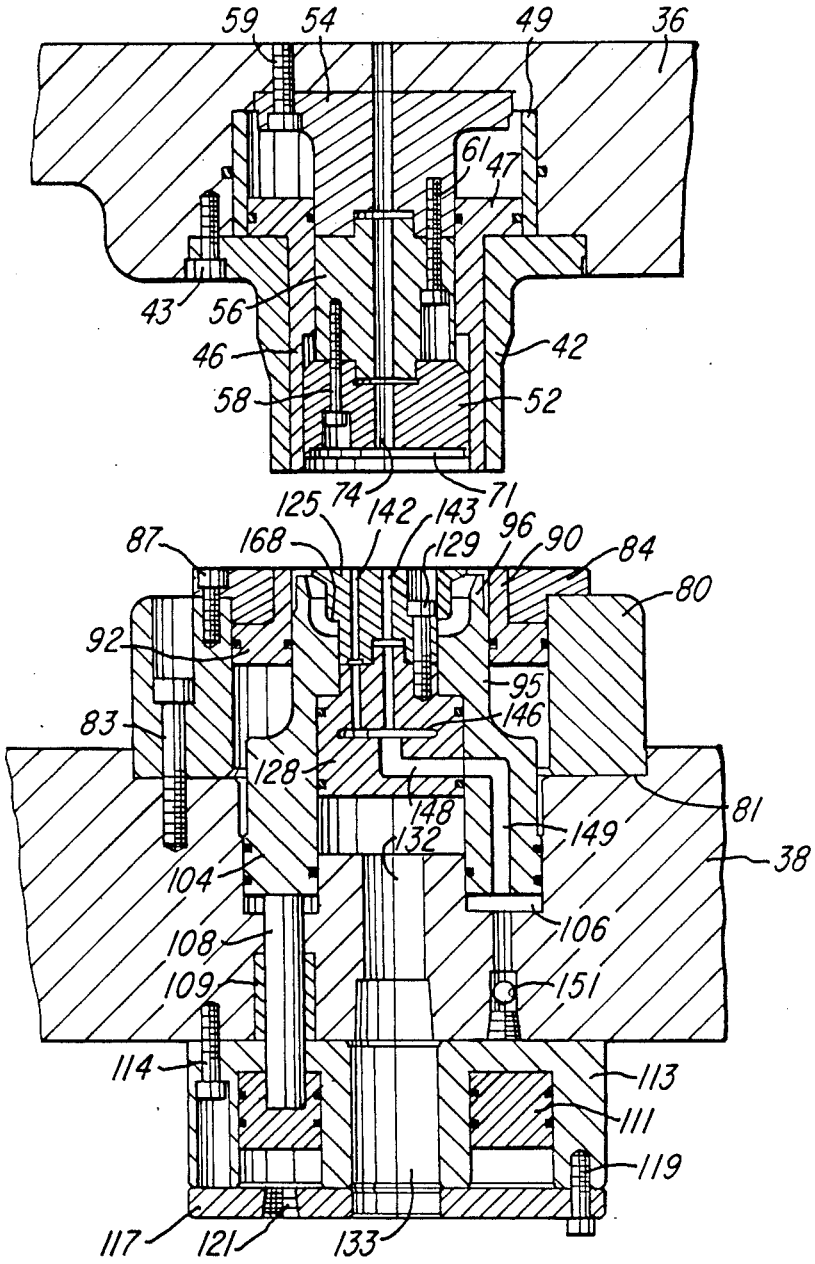
FIG. 1 is an axial section of a tooling assembly or system constructed and operated in accordance with the invention.

Referring to FIG. 1, the shell 15 is produced on a tooling system or assembly 35 which mounts on an upper die shoe 36 and a lower die shoe 38 supported by bolster plates within a conventional high speed single action or multiple action press. An annular blank and draw die 42 has an upper flange portion secured to the upper die shoe 36 by a set of screws 43, and the die 42 surrounds an upper pressure sleeve 46. The sleeve 46 has a top piston portion 47 slidably supported within a cylindrical liner 49 confined within a bore within the upper die shoe 36. An inner die member or die center 52 is supported within the upper pressure sleeve 46 by a die center riser 54 and a riser extension 56 which is secured to the die center 52 by a set of screws 58. Another set of screws 59 secure the die center riser 54 to the upper die shoe 36, and a set of screws 61 secure the riser extension 56 to the die center riser 54.

Figure 2:
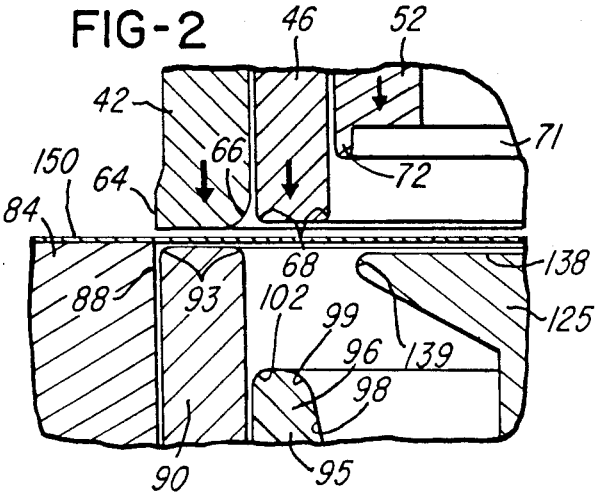
FIGS. 2–8 are enlarged fragmentary sections of the tooling assembly shown in FIG. 1 and illustrating the progressive steps for producing a shell in accordance with the invention.

As shown in FIG. 2, the blank and draw die 42 has a cylindrical lower cutting edge 64 and an inner curved forming surface 66. The lower end of the upper pressure sleeve 46 has curved forming surfaces 68, and a lower end of the die center 52 as a circular recess or cavity 71 defined by an annular projection 72. The projection 72 has a curved bottom surface with a radius of 0.020" or less, and preferably about 0.015". As also shown in FIG. 1, an axial vent passage 74 is formed within the center of the die center 52, riser extension 56 and within the die center riser 54 and extends through the upper die shoe 36.

An annular tooling or die retainer 80 is mounted on the lower die shoe 38 within a circular counterbore 81 and is secured by circumferentially spaced screws 83. An annular cut edge die 84 is secured to the retainer 80 by peripherally spaced screws 87 and has an inner cylindrical cutting edge 88 (FIG. 2) with substantially the same diameter as the cutting edge 64 on the blank and draw die 42. An annular lower pressure sleeve 90 has a lower piston portion 92 supported by sliding movement within the retainer 80, and the sleeve 90 has an upper end surface with curved edges 93 (FIG. 2) with a radius substantially the same as the radius of the curved surfaces 68.

A die core ring 95 is positioned within the lower pressure sleeve 90 and has an upper end portion 96 (FIG. 2) with an inner frusto-conical surface 98, an inner curved surface 99 and an outer curved surface 102. The die core ring 95 has a lower piston portion 104 which is received within an annular bore or recess 106 formed within the lower die shoe 38. The lower end portion 104 is supported by a set of three circumferentially spaced slide pins 108 which extend through corresponding bushings 109 within the lower die shoe 38. The lower end portions of the support pins 108 are received within a die core ring piston 111 supported within an annular piston retainer or housing 113 secured to the bottom of the lower die shoe 38 by a series of circumferentially spaced screws 114. An annular retaining cap 117 is secured to the bottom end of the piston housing 113 by a set of screws 119, and a port 121 provides for supplying pressurized fluid or air to the housing 113 below the piston 111.

A circular panel punch 125 (FIG. 1) is positioned within the die core ring 95 and is secured to a panel punch piston 128 by a set of screws 129. The panel punch piston 128 is supported for axial movement within the die core ring 95, and fluid or air pressure is introduced into the die core ring 95 under the piston 128 through an axially extending passage 132 within the lower die shoe 38. A fluid or air supply line (not shown) is connected to the passage 132 through a center hole 133 within the piston housing 113 and cap 117.

Referring to FIG. 2, the panel punch 125 has a circular flat upper surface 138 which extends to a curved peripheral surface 139 having a radius of about 0.020" or less. The panel punch 125 also has a set of three circumferentially spaced and axially extending air passages 142 (FIG. 1) and a center air passage 143 which extend into the panel punch piston 28 to a connecting header passage 146. A set of air passages 148 and 149 connect the passage 146 to an air supply passage 151 within the lower die shoe 38. Pressurized air is also supplied to the chamber within the retainer 80 and below the lower pressure sleeve 90 by an air supply passage (not shown) within the lower die shoe 38.

Figure 3:
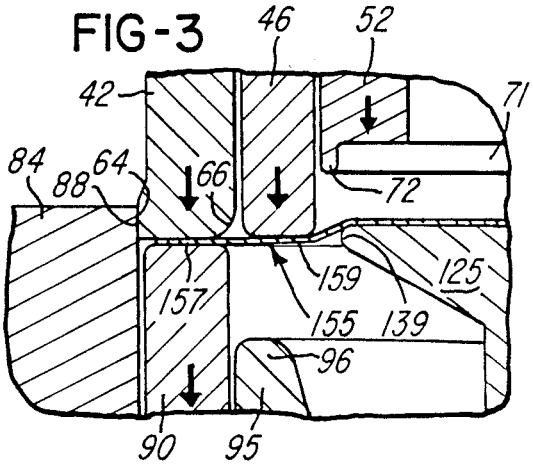
Figure 4:
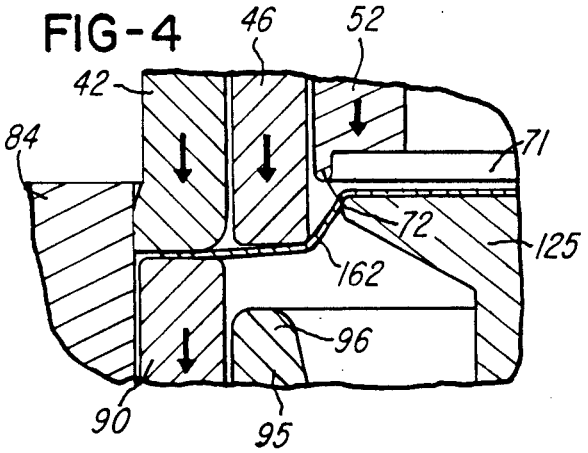
Figure 5:
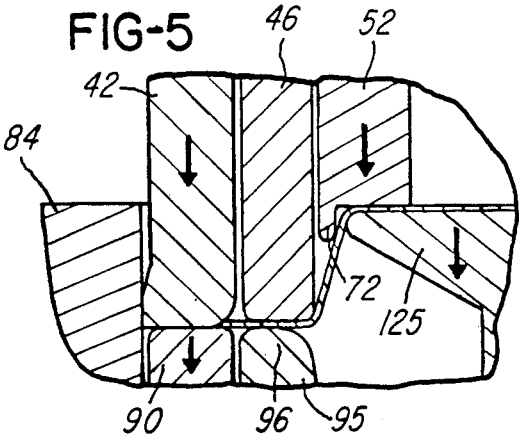

The operation of the tooling system or assembly 35 for successively forming shells 15, is now described in connection with FIGS. 2–11. As shown in FIG. 2, a continuous strip or sheet 150 of aluminum having a thickness of about 0.010", is fed across the cut edge die 84 and below a guide or stripper plate 152 (FIG. 9). When the upper die shoe 36 moves downwardly, the mating shearing edges 64 and 88 (FIG. 2) blank out a circular disk 155 (FIG. 3). As the blank and draw die 42 continues to move downwardly (FIG. 3), a peripheral edge portion 157 of the disk 155 is confined between the die 42 and the upper end of the lower pressure sleeve 90. As the upper pressure sleeve 46 moves downwardly with the blank and draw die 42 (FIG. 2), an annular immediate portion 159 of the disk 155 begins to wrap around the peripheral curved surface 139 on the panel punch 125. The air pressure below the lower pressure sleeve 90 is selected to produce a predetermined clamping or gripping pressure against the peripheral portion 157 of the disk 155 and which allows the peripheral portion 157 to slide radially inwardly between the die 42 and lower pressure sleeve 90.

As the blank and draw die 42 and upper pressure sleeve 46 continue to move downwardly (FIG. 4), an inner part of the intermediate portion 159 of the disk 155 forms into a frusto-conical inverted chuck wall portion 162, and the portion 162 wraps around the outer curved edge 139 of the panel punch 125 so that the center panel portion 16 is defined on top of the panel punch.

As the die center 52 moves further downwardly with the blank and draw die 42 (FIG. 5), the inverted chuck wall portion 162 increases, and the die center 52 contacts the panel wall portion 17 on the shell 15. A precision panel radius 22 is formed by wiping the portion 162 around the edge surface 139.

Figure 6:
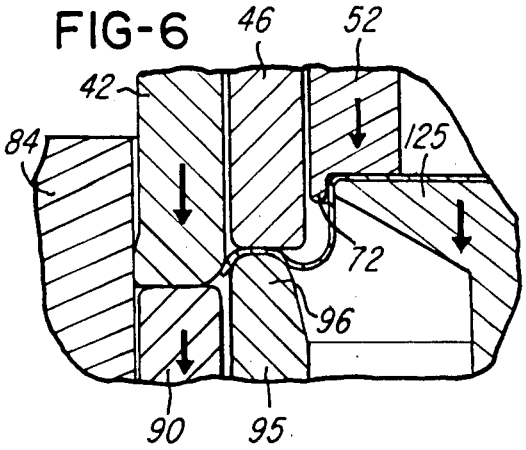
Figure 7:
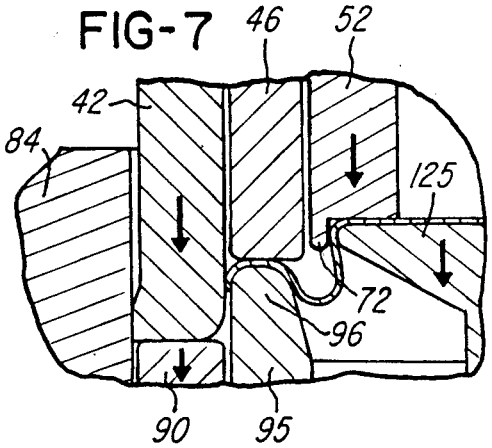

Referring to FIGS. 6 and 7, further downward movement of the blank and draw die 42 with the die center 52 and panel punch 125, causes the intermediate inverted chuck wall portion 162, to reverse bend or fold while an outer part of the intermediate portion is confined between the bottom end of the upper pressure sleeve 46 and the upper end of the die core ring 95. During this reverse forming of the inverted chuck wall portion 162, the sheet bellows downwardly below the lower curved end surface of the annular projection 72 on the die center 52. The continued downward movement of the blank and draw die 42 and the lower pressure sleeve 90 is also effective to form or wrap the peripheral portion 157 of the disk 155 downwardly against the outer surface of the upper portion 96 of the die core ring 95, as also shown in FIGS. 6 and 7.

Figure 8:
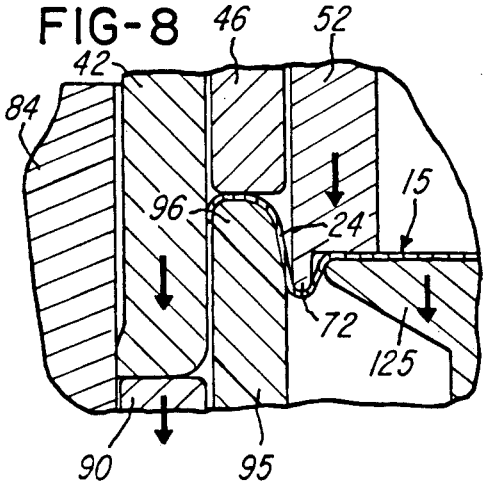
Figure 9:
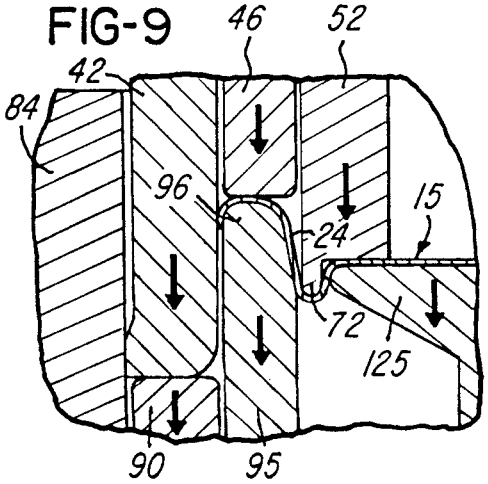
FIG. 9 is a fragmentary section similar to FIG. 7 and illustrating an overstroke operation.
Figure 10:
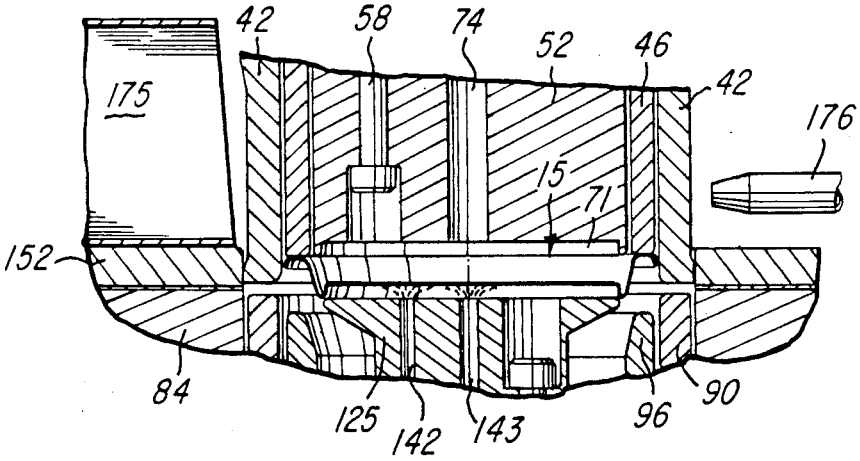
FIGS. 10 and 11 are fragmentary sections of the tooling assembly shown in FIG. 1 and illustrating the removal of a shell after it is formed.
Figure 11:
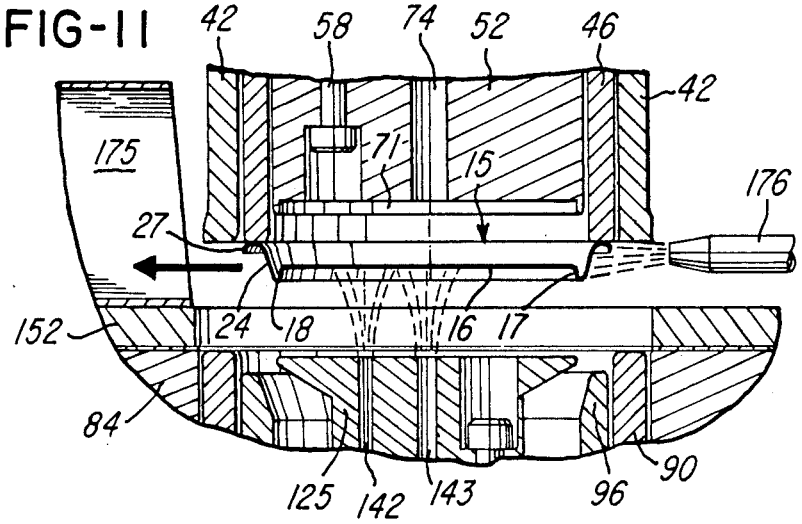

As the blank and draw die 42, the die center 52 and panel punch 125 continue to move downwardly relative to the upper pressure sleeve 46 and die core ring 95, as shown in FIG. 8, the shell 15 is completely formed with the chuck wall 24 being defined by the tapered surface 98 on the die core ring 95 and with the crown portion 26 defined between the upper pressure sleeve 46 and the die core ring 95. The countersink portion 18 of the shell 15 is provided with a precision and uniform radius by the projection 72 on the die center 52, and the peripheral lip portion 27 is confined between the inner surface of the blank and draw die 42 and the outer surface of the upper portion 96 of the die core ring 95.

When the annular shoulder 168 (FIG. 1) on the panel punch 125 engages the opposing surface of the die core ring 95 and the shell 15 is completely formed (FIG. 8), further downward movement of the die center 52 and the panel punch 125 causes the die core ring 95 to move downwardly against the force produced by the air pressure below the die core ring piston 111, thereby forming an overstroke operation, as shown in FIG. 9. This overstroke operation assures that each shell 15 has precision dimensions and compensates for thermal expansion in the press and tooling assembly 35.

After a shell 15 is completed and the overstroke operation (FIG. 9) is performed, the upper die shoe 36 is moved upwardly by the press (FIG. 10) while the shell 15 is retained by friction within the blank and draw die 42. The shell 15 is released from the die center 52 by downward movement of the upper pressure sleeve 46 and venting through the passage 74. While the upper die shoe 36 is moving upwardly, pressurized jets of air are directed upwardly from the air passages 142 and 143 (FIGS. 10 and 11) so that the shell 15 is held against upper pressure sleeve 46 having a bottom end surface concaved to receive and locate the crown 26. When the blank and draw die 42 reaches to a predetermined elevation, the upper pressure sleeve 46 and shell are shifted downwardly to the starting position, and the shell is released by the vent passage 74 so that the shell 15 is free for lateral ejection or discharge into a guide chute 175 by a jet of air from a nozzle 176 connected to a pressurized air supply.

From the drawings and the above description, it is apparent that the method and apparatus of the present invention, provides desirable features and advantages. As one advantage, the tooling assembly of the invention is adapted for use on a single action press with a shell or other cup-shaped article being completely formed at a single tooling station. The method and apparatus also permit a significant reduction in the sheet metal thickness while maintaining the strength of the shell to withstand substantial pressure within the container without buckling or deforming the shell. The invention also simplifies the tooling assembly by eliminating ejector or knock-out rods and their operating mechanism. This permits a shorter press stroke so that the press may be operated at a higher speed. As mentioned above, the formation of the center panel portion 16, the countersink portion 18 and the chuck wall portion 24 avoids stretching and thinning of the thin sheet metal around the panel radius and countersink radius so that a thinner gage sheet metal may be used.

As another feature, the overstroke operation illustrated in FIG. 9 provides for producing shells 15 or other cup-shaped articles with precision dimensions and independent of thermal expansion of the press and tooling. The invention further provides for minimizing the panel radius and countersink radius under 0.020" and for assuring that each radius is uniform so that maximum strength may be obtained from the thinner gage sheet metal. Furthermore, by wrapping or laying the sheet metal around the panel radius and around the countersink radius instead of drawing the center panel portion and/or the countersink portion, recycled aluminum material may be used for producing shells instead of a new material, resulting in a significant cost savings. In addition, the release and discharge of the shells from the tooling with the aid of the air jets within the panel punch 125 and nozzle 176, provide for high speed, successive and dependable removal of the shells from the tooling so that jamming of the tooling is avoided.

While the method and form of apparatus herein described constitute a preferred embodiment of the invention, it is to be understood that the invention is not limited to the precise method and form of apparatus described, and that changes may be made therein without departing from the scope and spirit of the invention as defined in the appended claims.

The invention having thus been described, the following is claimed:

1. A method of forming a cup-shaped can end wall or shell from a flat metal sheet, the shell including a center panel portion having a peripheral panel radius and connected by a panel wall portion to a countersink portion having a countersink radius and with the countersink portion connected to a crown portion by a chuck wall portion, the method comprising the steps of blanking a disk from the sheet, gripping a peripheral portion of the disk, moving the peripheral portion axially in one direction relative to a center portion of the disk supported by a center panel punch to define the center panel portion and the panel wall portion with the panel wall portion connected by an inverted chuck wall portion to the peripheral portion, deforming the peripheral portion to define the crown portion, and moving the center panel punch and the center panel portion axially in the same direction and relative to the crown portion to reverse form the inverted chuck wall portion into the chuck wall portion and the countersink portion.

2. A method as defined in claim 1 wherein the metal sheet is wrapped around a peripheral curved surface on the center panel punch when the peripheral portion of the disk is moved axially relative to the center portion to define the panel radius of the center panel portion.

3. A method as defined in claim 2 wherein the center panel portion of the disk is confined between the center panel punch and a peripheral lip projecting from a die center and surrounding the center panel punch and while the center panel portion is moved axially to reverse form the inverted chuck wall portion.

4. A method as defined in claim 1 wherein the peripheral portion of the disk is confined between an upper pressure sleeve and a die core ring during the reverse forming of the inverted chuck wall portion.

5. A method as defined in claim 4 wherein the crown portion and the chuck wall portion are formed by surfaces on the die core ring during the reverse forming of the inverted chuck wall portion.

6. A method as defined in claim 1 and including the step of directing streams of air in an axial direction towards the shell after the shell is formed to aid in rapid removal of the shell from the tooling which forms the shell.

7. A method of forming a can end wall or shell from a flat metal sheet, the shell including a center panel portion having a peripheral panel radius and connected by a panel wall portion to a countersink portion having a countersink radius and with the countersink portion connected to a brown portion and a depending lip portion by a chuck wall portion, the method comprising the steps of blanking a disk from the sheet, gripping an outer part of a peripheral portion of the disk, moving the peripheral portion axially in one direction relative to a center portion of the disk supported by a center panel punch to define the center panel portion and the panel wall portion with the panel portion connected by a inverted chuck wall portion to the peripheral portion, gripping an inner part of the peripheral portion to define the crown portion, forming the outer part of the peripheral portion into the lip portion, and moving the center panel punch and the center panel portion axially in the same direction and relative to the crown portion while forming the lip portion and in a direction to reverse form the inverted chuck wall portion into the chuck wall portion and the countersink portion.

8. A method as defined in claim 7 wherein the center portion of the disk is wrapped around a peripheral curved surface on the center panel punch when the peripheral portion of the disk is moved axially to define the center panel portion, the panel wall portion and the inverted chuck wall portion.

9. A method as defined in claim 8 wherein the center portion of the disk is confined between the center panel punch and a die center having a peripheral projecting lip surrounding the center panel punch and while the center panel portion is moved axially to reverse form the inverted chuck wall portion.

10. A method as defined in claim 7 wherein the inner part of the peripheral portion of the disk is gripped between a pressure sleeve and an opposing die core ring during the reverse forming of the inverted chuck wall portion.

11. A method as defined in claim 10 wherein the crown portion, the lip portion and the chuck wall portion are formed by surfaces on the die core ring during the reverse forming of the inverted chuck wall portion.

12. A method as defined in claim 7 and including the step of shifting all of the portions of the shell axially after the shell is formed and through an overtravel stroke to provide for thermal expansion of the press and tooling used for producing the shell.

13. A method as defined in claim 7 and including the step of directing streams of air in an axial direction towards the shell after the shell is formed to aid in rapid removal of the shell from the tooling which forms the shell.

14. A method of forming a cup-shaped can end wall or shell from a flat metal sheet, the shell including a center panel portion having a peripheral panel radius and connected by a panel wall portion to a countersink portion having a countersink radius and with the countersink portion connected to a crown portion by a chuck wall portion, the method comprising the steps of blanking a disk from the sheet while gripping a peripheral portion of the disk, moving the peripheral portion axially in one direction relative to a center portion of the disk retained by a center panel punch having a peripheral rounded surface corresponding to the panel radius to define a flanged cup including the center panel portion, the panel radius and the panel wall portion with the panel wall portion connected by an inverted frusto-conical chuck wall portion to a flange-like peripheral portion, deforming the peripheral portion to define the crown portion, and moving the center panel portion axially in the same direction with a die center and the center panel punch and relative to the crown portion to reverse form the inverted chuck wall portion into the chuck wall portion and the countersink portion to form the shell, and then removing the shell in the opposite direction without deforming the shell.

15. A tooling system adapted for forming a can end wall or shell from a flat metal sheet and adapted for use in a single action press, the shell including a center panel portion having a panel radius and connected to a crown portion by a chuck wall portion and a countersink portion having a countersink radius, said tooling system comprising an annular blank die and an opposing annular first pressure sleeve supported for blanking a disk from the sheet, an annular second pressure sleeve within said blank die and an opposing annular die core ring within said first pressure sleeve, a die center within said second pressure sleeve and an opposing panel punch within said die core ring, said die center having a radially disposed base surface, said panel punch having an end surface opposing said base surface and a curved peripheral surface with a panel radius, means for moving said blank die, said first pressure sleeve and second pressure sleeve axially relative to said panel punch for moving a peripheral portion of the disk axially in one direction to define the center panel portion and said panel radius on said panel punch and to form an inverted chuck wall portion connecting the panel portion to the peripheral portion, means for gripping the peripheral portion of the disk between said second pressure sleeve and said die core ring to define the crown portion, and means for moving said die center and said panel punch axially as a unit and in the same direction relative to said second pressure sleeve and said die core ring for reverse forming the inverted chuck wall portion to form the chuck wall portion and the countersink portion.

16. A tooling system as defined in claim 15 wherein said die center has a projecting countersink forming lip portion closely surrounding said curved peripheral surface of said panel punch.

17. A tooling system as defined in claim 15 wherein said die core ring has a curved end surface and a tapered inner surface for forming the crown portion and the chuck wall portion during reverse forming the inverted chuck wall portion.

18. A tooling system as defined in claim 17 wherein said annular blank die has an inner cylindrical surface closely surrounding an outer cylindrical surface of said die core ring for wiping a peripheral edge portion of the disk around said end surface to form a peripheral lip portion depending from the crown portion.

19. A tooling system as defined in claim 15 and including means supporting said die core ring for axial movement with said second pressure sleeve after the article is formed to provide an overstroke operation for compensating for thermal expansion of the tooling system and the press which operates the system.

20. A tooling system as defined in claim 15 wherein said die center has a vent passage open to atmosphere, said panel punch has at least one axially extending air passage, and means for connecting said air passage to a source of pressurized air to provide for holding the article against said second pressure sleeve as the article is separated from said center die.

21. A tooling system adapted for forming a can end wall or shell from a flat metal sheet and adapted for use in a single action press, the shell including a center panel portion having a panel radius and connected to a crown portion and a depending lip portion by a frusto-conical chuck wall portion and a U-shaped countersink portion having a countersink radius, said tooling system comprising an annular blank die and an opposing annular first pressure sleeve supported for blanking a disk from the sheet, an annular second pressure sleeve within said blank die and an opposing annular die core ring within said first pressure sleeve, a die center within said second pressure sleeve and an opposing panel punch within said die core ring, said die center having a radially disposed base surface, said panel punch having an end surface opposing said base surface and a curved peripheral surface with a panel radius, means for moving said blank die, said first pressure sleeve and second pressure sleeve axially in one direction relative to said panel punch for moving a peripheral portion of the disk axially to define a flanged cup including the center panel portion with said panel radius and an inverted frustoconical chuck wall portion connecting the panel portion to the peripheral portion, means for deforming the peripheral portion of the disk with said blank die, said second pressure sleeve and said die core ring to define the crown portion, and means for moving said die center and said panel punch axially as a unit in the same direction and relative to said second pressure sleeve and said die core ring for reverse forming the inverted chuck wall portion into the chuck wall portion and the countersink portion.

* * * * *